US007765898B2

(12) United States Patent
Sakaguchi et al.

(10) Patent No.: US 7,765,898 B2
(45) Date of Patent: Aug. 3, 2010

(54) ROTARY TOOL

(75) Inventors: Yoshihiro Sakaguchi, Itabashi-ku (JP); Naoto Fujii, Itabashi-ku (JP); Ryosuke Ikeya, Itabashi-ku (JP)

(73) Assignee: GC Corporation, Tokyo (JP)

( * ) Notice: Subject to any disclaimer, the term of this patent is extended or adjusted under 35 U.S.C. 154(b) by 0 days.

(21) Appl. No.: 12/207,069

(22) Filed: Sep. 9, 2008

(65) Prior Publication Data

US 2009/0084227 A1 Apr. 2, 2009

(30) Foreign Application Priority Data

Sep. 28, 2007 (JP) ..... 2007-253675

(51) Int. Cl.
*B25B 13/46* (2006.01)
*B25B 13/02* (2006.01)

(52) U.S. Cl. ..... 81/60; 81/125

(58) Field of Classification Search ..... 81/125, 81/119, 60–63.2, 121.1, 124.7, 467, 479, 81/483, 124.6, 90.3, 180.1, 124.3
See application file for complete search history.

(56) References Cited

U.S. PATENT DOCUMENTS

| | | | | |
|---|---|---|---|---|
| 271,549 | A * | 1/1883 | True | 81/125 |
| 1,170,138 | A * | 2/1916 | Bohne et al. | 81/125 |
| 4,644,831 | A | 2/1987 | Yang | |
| 4,742,735 | A * | 5/1988 | Stencel | 81/121.1 |
| 4,787,278 | A * | 11/1988 | Bononi | 81/125 |
| 5,295,422 | A * | 3/1994 | Chow | 81/124.3 |
| 6,178,854 | B1 * | 1/2001 | Shih | 81/125 |
| 7,089,834 | B2 * | 8/2006 | Reynertson et al. | 81/479 |
| 7,437,977 | B2 * | 10/2008 | Hsieh | 81/124.6 |
| 2002/0166418 | A1 * | 11/2002 | Hsieh | 81/125 |
| 2003/0066393 | A1 * | 4/2003 | Mageson | 81/125.1 |
| 2003/0110903 | A1 * | 6/2003 | Creek | 81/125 |

FOREIGN PATENT DOCUMENTS

| | | |
|---|---|---|
| EP | 1 060 843 A2 | 12/2000 |
| JP | 2000-33580 | 2/2000 |
| JP | 2007-222972 | 9/2007 |

OTHER PUBLICATIONS

U.S. Appl. No. 29/325,103, filed Sep. 25, 2008, Ikeya, et al.

* cited by examiner

*Primary Examiner*—Hadi Shakeri
(74) *Attorney, Agent, or Firm*—Oblon, Spivak, McClelland, Maier & Neustadt, L.L.P.

(57) ABSTRACT

For accurate holding, easy attachment and detachment, and sufficient rotation force, a rotary tool has a holding and transmitting part 1 to hold a hexagonal column of a rotated body and give rotation force, comprising a recessed part 2, which has an inner face having an approximately regular triangle cross sectional shape, run-off parts 2*a* at corners of the triangle shape, and a uniform shape in depth direction, and plate springs 3, which are fixed at a bottom of the recessed part 2 and have pawl parts 3*a* at tips thereof positioned at the opening side of the recessed part 2, and the pawl parts 3*a* can be moved into the run-off parts 2*a* while contacting to three side faces of the hexagonal column H and generate spring force, when the hexagonal column H is inserted into the recessed part 2.

4 Claims, 4 Drawing Sheets

ROTARY TOOL

BACKGROUND OF THE INVENTION

1. Field of the Invention

The present invention relates to a rotary tool, such as a driver or a wrench, capable of accurately holding a hexagonal column of a rotated body such as a bolt, a nut, or a bit, easily attaching and detaching the hexagonal column of the rotated body, and giving sufficient rotation force.

2. Description of the Conventional Art

A rotary tool, to which a rotated body such as a bit is attached, needs to accurately hold the rotated body not to be removed. Further, it is very important that the rotated body can be easily attached to and detached from the rotary tool so as to be easily exchanged. Therefore, as disclosed in Unexamined Japanese Patent Publication No. 2000-33580 (Claim 4), for example, a rotary tool often has a holding and transmitting part in which spherical bodies and pressing springs are used.

As in Unexamined Japanese Patent Publication No. 2000-33580 for example, the holding and transmitting part includes spherical bodies inserted and provided in windows provided at necessary parts of a socket main body, and a pressing springs for inwardly thrusting the spherical bodies from the windows so as to engage them with engagement recessed parts of a bit.

Such the conventional holding and transmitting part in which spherical bodies and pressing springs are used can engage the spherical bodies with recessed parts formed at a rotated body, and thus the rotary tool can accurately hold the rotated body. Further, since the pressing springs are used, the rotated body can be easily attached to and detached from the rotary tool. However, in this rotary tool, there are faults that it takes time and effort for producing, because the holding and transmitting part has through holes to insert the spherical bodies and the pressing springs must be attached.

When a rotary tool for rotating a hexagonal column of a rotated body such as a bolt or a nut is used, an operation is very easily carried out if the hexagonal column of a bolt or a nut is in a state of being previously held in the rotary tool. As for such the holding and transmitting part for a hexagonal column of a rotated body such as a bolt, as disclosed in Unexamined Japanese Patent Publication No. 2007-222972 for example, there is a bolt holding tool of a driver in which a magnetic member is provided at the tip end side of a cylindrical member mounted on a shaft body of the driver and a bolt head is held thereto by attraction of magnetic force.

In case of the driver having the bolt holding tool for holding a bolt by magnetic force, the bolt can be easily attached and detached. However, since attaching force by magnetic force is low, it is hard to accurately hold a bolt. Further, the driver cannot be used for a bolt made of a nonmagnetic material.

Further, as for general rotary tools which hold a hexagonal column of a rotated body and give rotation force, there are a closed wrench and a spanner. A holding and transmitting part of a closed wrench can give great rotation force by giving force to whole six sides of the hexagonal column of a rotated body. However, since a cross section of an inner part of the holding and transmitting part has an approximately similar shape to an outer shape of the hexagonal column of the rotated body, there is a fault that it is hard to attach the rotated body and to handle it. A holding and transmitting part of a spanner includes an opening part, and thus a rotated body can be easily attached and detached. However, the spanner is a rotary tool which gives force to only two faces of the hexagonal column of a rotated body, and thus cannot give great rotation force.

As for a rotary tool to compensate faults of both the closed wrench and the spanner, there is a rotary tool called as a combination wrench having a closed wrench at one end and a spanner at another end. However, since an operator must work by selecting appropriate one of the closed wrench and the spanner at the both ends each time, there is a fault that the operation is very hard.

SUMMARY OF THE INVENTION

The present invention solves the above-described problems, and an objective of the present invention is to provide a rotary tool capable of accurately holding a hexagonal column of a rotated body, easily attaching and detaching the hexagonal column of the rotated body, and giving sufficient rotation force.

Present inventors carried out earnest works to solve the above-described problems and, as a result, they found out the followings to complete the present invention. A holding and transmitting part to hold a hexagonal column of a rotated body and give rotation force includes a recessed part and plate springs. The recessed part has an inner face formed to have an approximately regular triangle shape in cross section, has run-off parts at respective corners of the triangle shape, and has a uniform shape in the depth direction. The plate springs are fixed at a bottom part of the recessed part and have pawl parts at a tip ends thereof which are positioned at the opening end side of the recessed part. When the hexagonal column of the rotated body is inserted into the recessed part, the pawl parts can be moved into the run-off parts while contacting to three side faces of the hexagonal column of the rotated body so as to generate spring force. Thereby, the holding and transmitting part can be remarkably simplified, because of having only the plate springs, differently from a conventional rotated body holding and transmitting part in which spherical bodies and pressing springs are used. Further, large spring force can be generated by use of the plate springs so that a rotated body can be accurately held with the pawl parts at the tip ends. Further, the rotated body can be easily attached and detached, because it is held with only the plate springs. Furthermore, the holding and transmitting part has an inner face formed to have an approximately regular hexagon shape in cross section with three side faces of the recessed part and three plate springs fixed at respective corners of the recessed part. Thus, when the rotated body is attached, force can be given to the whole six side faces of the hexagonal column of the rotated body, thereby great rotation force being given.

That is, according to an aspect of the present invention, a rotary tool is structured such that a holding and transmitting part to hold a hexagonal column of a rotated body and give rotation force includes a recessed part and plate springs, the recessed part has an inner face formed to have an approximately regular triangle shape in cross section, has run-off parts at respective corners of the triangle shape, and has a uniform shape in the depth direction, the plate springs are fixed at a bottom part of the recessed part and have pawl parts at tip ends thereof which are positioned at the opening end side of the recessed part, and the pawl parts can be moved into the run-off parts while contacting to three side faces of the hexagonal column of the rotated body so as to generate spring force, when a hexagonal column of the rotated body is inserted into the recessed part.

When the rotary tool according to the present invention is a driver, the driver can be easily used at a narrow space, and thus it is preferable. When the rotary tool according to the present invention is a wrench, the wrench can give large rotation force, and thus it is preferable. Further, in the latter case, the wrench can be a ratchet type torque wrench which has a cylindrical mounting part with openings in both end faces thereof, at an end part in the longitudinal direction of a holding part and can detect a torque when a rotated body is rotated in a predetermined direction. In such the ratchet type torque wrench, a holding and transmitting part can be attached to and detached from the mounting part through any of the openings. Therefore, the rotation direction can be freely changed to be clockwise or counterclockwise by only removing the holding and transmitting part and changing an attaching position. Thus, it is preferable.

In a rotary tool according to the present invention, a holding and transmitting part to hold a hexagonal column of a rotated body and give rotation force includes a recessed part and plate springs, the recessed part has an inner face having an approximately regular triangle shape in cross section, has run-off parts at respective corners of the triangle shape, and has a uniform shape in the depth direction, the plate springs are fixed at a bottom part of the recessed part and have pawl parts at tip ends thereof which are positioned at the opening end side of the recessed part, and the pawl parts can be moved into the run-off parts while contacting to three side faces of the hexagonal column of the rotated body so as to generate spring force, when the hexagonal column of the rotated body is inserted into the recessed part. Thereby, the holding and transmitting part can be remarkably simplified, because of having only the plate springs, differently from a conventional holding and transmitting part in which spherical bodies and pressing springs are used. Further, large spring force can be generated by use of the plate springs so that the hexagonal column of a rotated body can be accurately held with the pawl parts at the tip ends. Further, the hexagonal column of the rotated body can be easily attached and detached, because it is held with only the plate springs. Furthermore, the holding and transmitting part has an inner face formed to have an approximately regular hexagon shaped cross sectional shape with three side faces of the recessed part and three plate springs fixed at respective corners of the recessed part. Thus, when the hexagonal column of the rotated body is attached, force can be given to the whole six side faces of the hexagonal column of the rotated body, and thus great rotation force can be given. Further, three side faces among six inner faces are formed with the plate springs. Thus, when the hexagonal column of the rotated body is mounted, it is inserted, while pushing the three plate springs aside into the run-off parts. Therefore, the hexagonal column of the rotated body can be easily mounted, differently from a general closed wrench having a fixed-shaped inner face.

Further, when the rotary tool according to the present invention is a driver, the driver can be easily used at an arrow space, and thus it is preferable. When the rotary tool according to the present invention is a wrench, the wrench can give large rotation force, and thus it is preferable. Further, in the latter case, the wrench can be a ratchet type torque wrench which has a cylindrical mounting part with openings in both end faces thereof, at an end part in the longitudinal direction of a holding part and can detect a torque when a rotated body is rotated in a predetermined direction. In this ratchet type torque wrench, since a holding and transmitting part can be attached to and detached from the mounting part through any of the openings, the rotation direction can be freely changed to be clockwise or counterclockwise by only removing the holding and transmitting part and changing an attaching position.

DETAILED DESCRIPTION OF PREFERRED EMBODIMENT

A rotary tool according to the present invention will be described in detail below with reference to the drawings.

Figure 1:
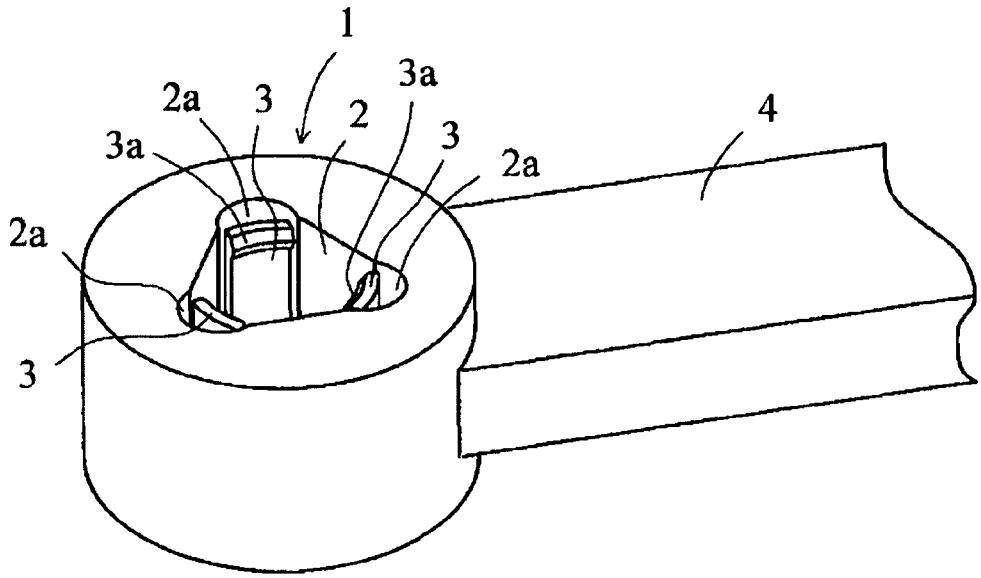
FIG. 1 is an enlarged perspective view to illustrate one example of a wrench type rotary tool according to the present invention.
Figure 2:
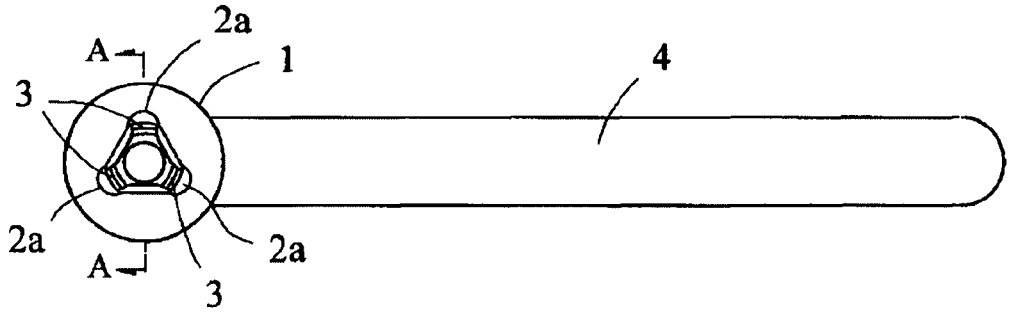
FIG. 2 is a front view of the rotary tool in FIG. 1.
Figure 3:
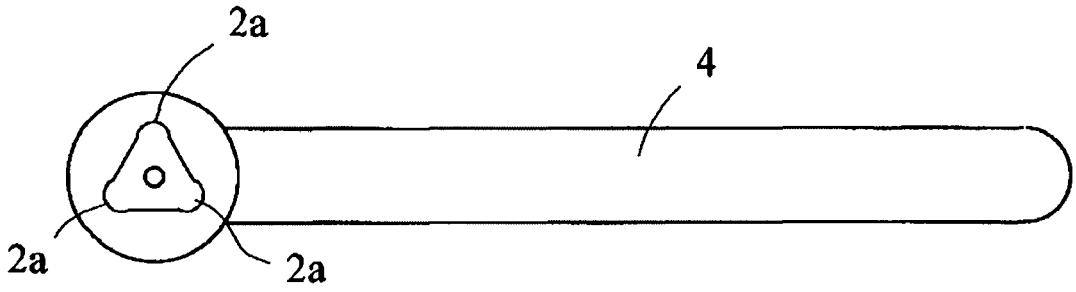
FIG. 3 is a front view to illustrate a state that plate springs are removed from the rotary tool in FIG. 1.
Figure 4:
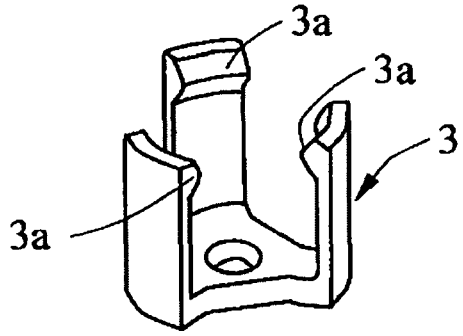
FIG. 4 is an enlarged perspective view to illustrate plate springs attached to the rotary tool in FIG. 1.
Figure 5:
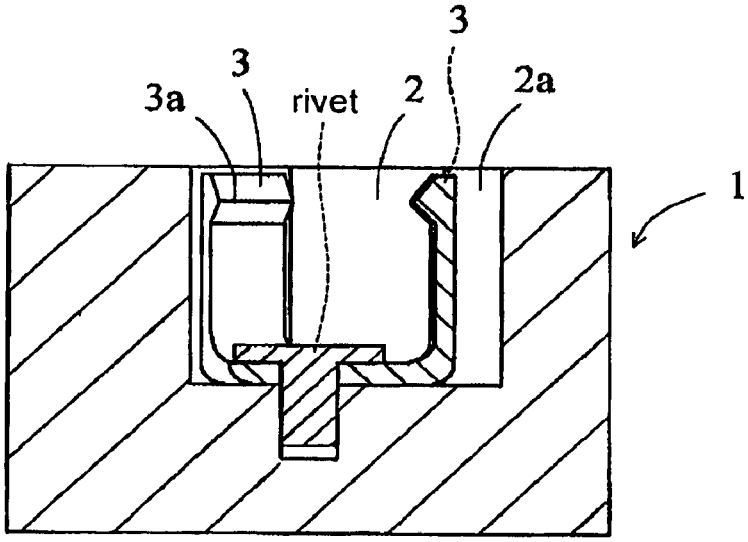
FIG. 5 is an enlarged sectional view taken along the A-A line in FIG. 2.
Figure 6:
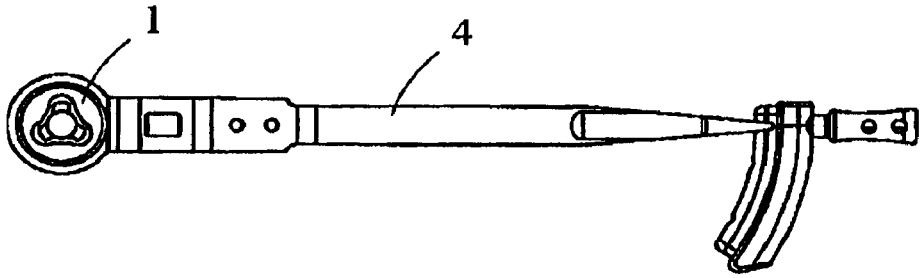
FIG. 6 is a front view to illustrate one example of a rotary tool which is a ratchet type torque wrench according to the present invention.
Figure 7:
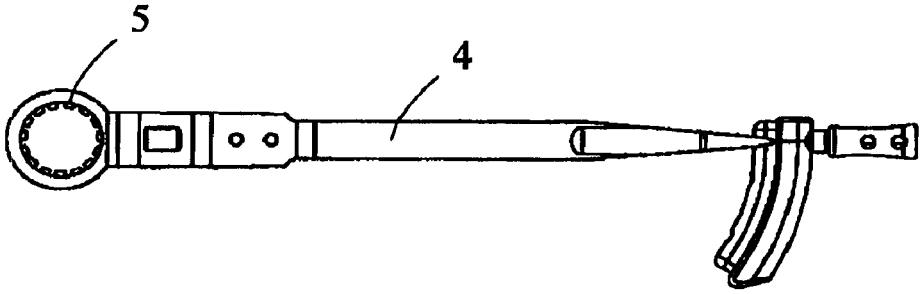
FIG. 7 PRIOR ART
FIG. 7 is a front view to illustrate a state that a holding and transmitting part is removed from the rotary tool in FIG. 6.
Figure 8:
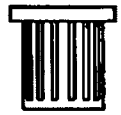
FIG. 8 is an enlarged plan view of a holding and transmitting part attached to the rotary tool in FIG. 6.
Figure 9:
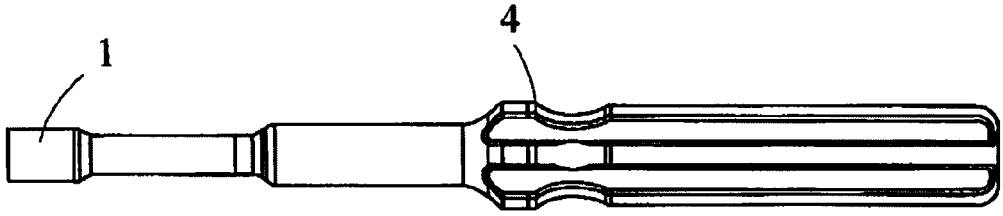
FIG. 9 is a front view to illustrate one example of a driver type rotary tool according to the present invention.
Figure 10:
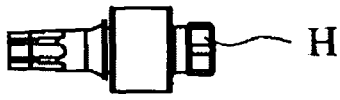
FIG. 10 is a front view to illustrate one example of a bit type rotated body mounted on a rotary tool according to the present invention.

FIG. 1 is an enlarged perspective view to illustrate one example of a wrench type rotary tool according to the present invention. FIG. 2 is a front view of the rotary tool in FIG. 1. FIG. 3 is a front view to illustrate a state that plate springs are removed from the rotary tool in FIG. 1. FIG. 4 is an enlarged perspective view to illustrate plate springs attached to the rotary tool in FIG. 1. FIG. 5 is an enlarged sectional view taken along the A-A line in FIG. 2. FIG. 6 is a front view to illustrate one example of a rotary tool which is a ratchet type torque wrench according to the present invention. FIG. 7 is a front view to illustrate a state that a holding and transmitting part is removed from the rotary tool in FIG. 6. FIG. 8 is an enlarged plan view of a holding and transmitting part attached to the rotary tool in FIG. 6. FIG. 9 is a front view to illustrate one example of a driver type rotary tool according to the present invention. FIG. 10 is a front view to illustrate one example of a bit type rotated body mounted on a rotary tool according to the present invention.

In these drawings, a hexagonal column H is formed at a rotated body to be attached to and detached from a rotary tool according to the present invention. When the rotated body is a bit, the hexagonal column H indicates a hexagonal portion formed at an end part of the bit as illustrated in FIG. 10. When the rotated body is a bolt, the hexagonal column H indicates a head portion of the bolt. When the rotated body is a nut, the hexagonal column H indicates the whole of the nut.

A holding and transmitting part 1 holds the hexagonal column H of the rotated body and gives rotation force. The holding and transmitting part 1 includes a recessed part 2 and plate springs 3.

The recessed part 2 has an inner face having an approximately regular triangle shape in cross section, has run-off parts 2*a* at respective corners of the triangle shape, and has a uniform shape in the depth direction. The plate springs 3 are fixed at a bottom part of the recessed part 2 and have pawl parts 3*a* at tip ends thereof which are positioned at the opening end side of the recessed part 2.

As for the plate springs 3, when the hexagonal column H of the rotated body is inserted into the recessed part 2, the pawl parts 3*a* can be moved into the run-off parts 2*a* while contacting to three side faces of the hexagonal column H of the rotated body so as to generate spring force.

The rotary tool according to the present invention includes a holding part 4 and the holding and transmitting part 1.

A cylindrical mounting part 5 is formed at an end part in the longitudinal direction of the holding part 4 and has openings in both end faces. In a ratchet type torque wrench capable of detecting torque when rotating a rotated body in a predetermined direction, when the mounting part 5 is formed, the holding and transmitting part 1 can be attached to and detached from the mounting part 5 through any of the openings. Thus, it is preferable.

The rotary tool according to the present invention has a feature in the holding and transmitting part 1 which holds the hexagonal column H of the rotated body and gives rotation force. The holding and transmitting part 1 includes the recessed part 2 and the plate springs 3. As illustrated in FIG. 3, the recessed part 2 has an inner face having an approximately regular triangle shape in cross section, has the run-off parts 2*a* at respective corners of the triangle shape, and has a uniform shape in the depth direction. As illustrated in FIG. 4, the plate spring 3 has the pawl part 3*a* at a tip end thereof. The rotary tool according to the present invention needs three plate springs, but an integrally formed combination of three plate springs as illustrated in FIG. 4 can be used. Further, when holes are previously formed at centers of respective bottom parts of such the integrally formed plate springs 3 and the recessed part 2 as illustrated in FIGS. 3 and 4, the integrally formed plate springs 3 can be easily fixed in the recessed part 2 with a rivet. Thus, the rotary tool can be very easily produced.

In the rotary tool according to the present invention, the inner face having the approximately regular hexagon shape in cross section is formed with the three side faces of the recessed part 2 and the three plate springs at the run-off parts 2*a* formed at respective corners of an approximately regular triangle shape of the recessed part 2. Thus, when the rotated body is mounted, force can be given to whole six side faces of the hexagonal column H of the rotated body, and thus large rotation force can be given. Further, since three side faces among six side faces are formed with the spring parts of the plate springs 3, when the rotated body is mounted, it is inserted while pushing the three plate springs aside into the run-off parts. Thus, the hexagonal column H of the rotated body can be easily mounted, differently from a general closed wrench having a fixed-shaped inner face.

In a conventional body holding and transmitting part in which spherical bodies and pressing springs are used, a coil-shaped or ring-shaped springs are used as the pressing springs. However, in the rotary tool according to the present invention, larger spring force can be generated by use of the plate springs 3. Further, the rotated body is not engaged with the spherical bodies but is engaged with the pawl parts 3*a* of the plate springs 3. Thus, the rotary tool can hold the rotated body more accurately.

As explained above, the rotary tool according to the present invention can accurately hold the hexagonal column H of the rotated body, and give large rotation force. Thus, the rotary tool can be applied for various kinds of rotary tools. For example, when the rotary tool is used as a wrench or a driver, the recessed part 2 is directly formed at a tip end of the wrench or the driver, and the plate springs 3 are fixed in the recessed part 2, as illustrated in FIGS. 1, 2 and 9. Thereby, the holding and transmitting part 1 can be integrally formed with the wrench or the driver, and thus the wrench or the driver can be easily produced.

Further, as an embodiment that the holding and transmitting part 1 can be easily removed from the rotary tool, there is a ratchet type torque wrench as illustrated in FIGS. 6 and 7.

A very small ratchet type torque wrench is used in the fields of a medical treatment and a dental treatment. In such the wrench, a rotary tool may not include a switch mechanism to switch the rotation direction. In such the case, the cylindrical mounting part 5 having openings in both end faces is formed at one end of the ratchet type torque wrench as illustrated in FIG. 7, and the holding and transmitting part 1 is made to be attached to and detached from the mounting part 5 through any of the openings. Thereby, the rotation direction can be freely changed to be clockwise or counterclockwise by only removing the holding and transmitting part 1 and changing an attaching position.

What is claimed is:

1. A rotary tool, comprising:

a holding part;

a mounting part formed at an end of the holding part;

a holding and transmitting part received within said mounting part configured to hold a hexagonal column of a rotated body and apply rotation force thereto, the holding and transmitting part consisting of:

a recessed part defining a bottom face, an inner face having a triangular shape cross section, and having a uniform shape in a depth direction, the inner face defining three flats separated by three run-off parts formed at respective corners of the triangular shape, and a plate spring having a triangular base fixed to the bottom face of the recessed part, the base having three arm portions extending from a respective corner each having a pawl at a tip end, the base and the pawls corresponding to the triangular shape cross section and the run-off parts of the recessed part respectively, wherein the pawls are configured to be moved into the run-off parts while contacting three side faces of the hexagonal column of the rotated body so as to generate spring force when the hexagonal column of the rotated body is inserted into the recessed part; and wherein the holding and transmitting part defines a hexagonal shape engaging portion defined by the three flats and the three pawls for applying great rotational force to all six side faces of the hexagonal column when the hexagonal column of the rotated body is engaged.

2. The rotary tool as claimed in claim 1, wherein the rotary tool is a driver.

3. The rotary tool as claimed in claim 1, wherein the rotary tool is a wrench.

4. The rotary tool as claimed in claim 3, wherein the wrench is a ratchet type torque wrench, wherein the ratchet type torque wrench has a cylindrical mounting part including openings in both end faces thereof configured to receive the holding and transmitting part and detects torque when a rotated body is rotated in a predetermined direction, and wherein the holding and transmitting part is attached to and detached from the mounting part through any of the openings in the end laces the cylindrical mounting part.

* * * * *